US006135506A

United States Patent [19]

Chess et al.

[11] Patent Number: 6,135,506

[45] Date of Patent: Oct. 24, 2000

[54] MULTIPLE PART Z-FOLD MAILER

[75] Inventors: Stanley Chess, Goffstown; Wayne C. Peterson, Manchester, both of N.H.

[73] Assignee: Moore North America, Inc., Grand Island, N.Y.

[21] Appl. No.: 09/260,026

[22] Filed: Mar. 2, 1999

[51] Int. Cl.[7] ..... B42D 15/00; G09F 3/00

[52] U.S. Cl. ..... 283/80; 283/116; 283/62; 40/312; 462/26; 462/29

[58] Field of Search ..... 283/80, 116, 62; 40/312; 462/26, 29, 900

[56] References Cited

U.S. PATENT DOCUMENTS

| | | | |
|---|---|---|---|
| 2,706,865 | 4/1955 | Miller | 40/2 |
| 4,323,608 | 4/1982 | Denny et al. | 206/605 |
| 4,543,082 | 9/1985 | Stenner | 229/73 |
| 4,592,572 | 6/1986 | Instance . | |
| 4,621,837 | 11/1986 | Instance | 283/105 |
| 4,708,368 | 11/1987 | Instance . | |
| 4,711,686 | 12/1987 | Instance . | |
| 4,726,972 | 2/1988 | Instance . | |
| 4,744,161 | 5/1988 | Instance | 283/81 |
| 4,744,591 | 5/1988 | Instance . | |
| 4,747,618 | 5/1988 | Instance . | |
| 4,850,613 | 7/1989 | Instance . | |
| 4,955,640 | 9/1990 | Anderson | 229/73 |
| 5,193,850 | 3/1993 | Lombardo | 281/2 |
| 5,253,898 | 10/1993 | Mangione | 283/62 |
| 5,289,972 | 3/1994 | Sauerwine et al. . | |
| 5,318,324 | 6/1994 | Lombardo et al. . | |
| 5,366,145 | 11/1994 | Sauerwine | 229/305 |
| 5,366,410 | 11/1994 | Lombardo | 283/116 |
| 5,372,302 | 12/1994 | Loch et al. . | |
| 5,375,764 | 12/1994 | Sauerwine | 229/305 |
| 5,402,934 | 4/1995 | Sauerwine | 229/303 |
| 5,413,532 | 5/1995 | Raby | 462/2 |
| 5,513,795 | 5/1996 | Sauerwine . | |
| 5,573,277 | 11/1996 | Petkovsek | 283/79 |
| 5,779,612 | 7/1998 | Whitney | 283/117 |
| 5,893,512 | 4/1999 | Diedrich | 229/92.1 |
| 5,899,504 | 5/1999 | Fabel | 283/109 |

*Primary Examiner*—Willmon Fridie, Jr.
*Assistant Examiner*—Alisa Thurston
*Attorney, Agent, or Firm*—Nixon & Vanderhye P.C.

[57] ABSTRACT

A packing list or bill of lading may be easily manufactured from an intermediate comprising a single sheet of paper so that the form can be printed in either cut sheet or continuous format in a simple manner with a minimum amount of adhesive for attaching the form to a package, and with a maximum useful area on the form for informational indicia. The business form is constructed typically by Z or eccentrically Z-folding an intermediate about first and second fold lines to define three plies with aligned first and second lines of weakness formed in the plies substantially parallel to the first and second side edges of the plies and defining first and second detachable side strips preferably between about 1–1.25 inches wide. Patterns of pressure activated cohesive hold the detachable side strips of the plies to each other, and patterns of pressure sensitive adhesive covered by release strips and disposed only in the detachable side strips hold the form in contact with a package when the release liners are removed. Informational indicia may be imaged on both the top and bottom faces of both the second and third plies between the first and second lines of weakness, while the first ply top face has outgoing address indicia, as well as instructional indicia on how to detach the business form from a package. Informational indicia may also be imaged on the bottom face of the first ply.

20 Claims, 3 Drawing Sheets

MULTIPLE PART Z-FOLD MAILER

BACKGROUND AND SUMMARY OF THE INVENTION

The invention relates to an intermediate for a business form such as a packing list or bill of lading (as those terms are used in their broadest sense), the business form so produced, and a package containing the business form, which allow the maximum amount of informational indicia to be available to the addressee detaching the business form from the package, allowing detachment in as simple a manner as possible, and utilizing a minimum amount of pressure sensitive adhesive to hold the business form on the package.

U.S. Pat. No. 4,955,640 teaches a side stack type of Z-folding packing list/invoice which is known in the industry as a label stock and paper joined together. One of the panels of the business form of the U.S. Pat. No. 4,955,640 patent is substantially completely covered on the back thereof with pressure sensitive adhesive which is adhered to a package after a release liner is removed by pressing the adhesive into contact with the package. All of the back panel of the business form except for a tear strip which is specifically constructed in the business form, adheres to the package and cannot be removed. The form is constructed for use in continuous printers, and the label stock is a continuous strip of paper. Since the label stock is on one side of the intermediate from which the form is constructed, the form will have a lean in a stack when being fed to be printed in a landscape orientation. When the tear strip is removed from one side of the form, the form is then opened like a book.

U.S. Pat. No. 5,193,850 relates to a form with transfer tape that is designed for continuous laser impact printers, and is fed in a landscape orientation. Since the transfer tape is typically provided on one side of the form it will have a lean in a stack. One of the panels of the intermediate is adhered to the package with the adhesive of the transfer tape, and is not intended for removal. As with the form of the U.S. Pat. No. 4,955,640 patent, a tear strip is removed from one side of the form, and then the form is opened like a book.

The intermediate and form according to the present invention have a number of advantages compared to the above constructions (and other advantages compared to other prior art constructions). For example the intermediates of the invention can be used both in continuous or cut sheet format, and can run in portrait orientation through a conventional printer such as a laser impact printer. The panel that is adhered to the package is only adhered on spaced portions thereof, and the rest can easily be detached and worthwhile informational indicia imaged on either or both faces thereof that is useful to the addressee and can readily be accessed, and filed, return mailed, or the like. No tear strip is necessary to open the form once it has been attached to the package, but rather all of the elements thereof (except for the detachable side strips) are readily removed from the package. Also the intermediates of the invention can be stacked without a lean, or if there is one it does not adversely affect the leading edges fed to a printer.

According to one aspect of the present invention an intermediate for a business form (e.g. a packing list or a bill of lading, as those terms are most broadly used) is provided comprising the following elements: A single substantially quadrate sheet of paper having first and second faces, first and second side edges substantially parallel to each other, and first and second end edges substantially parallel to each other and substantially perpendicular to the side edges. First and second lines of weakness substantially parallel to and near the first and second side edges and defining first and second detachable side strips. At least first and second fold lines substantially parallel to the end edges and defining the sheet into at least three panels, a first panel between the first end edge and the first fold line, a second panel between the first and second fold lines, and a third panel. First and second patterns of adhesive or cohesive disposed in said detachable side strips for holding the intermediate in a folded configuration when folded about the fold lines. The first panel first face being substantially devoid of adhesive or cohesive. And, two patterns of pressure sensitive adhesive each covered by a release liner, the adhesive patterns disposed on the same face of one of the second and third panels and only in the detachable side strips thereof extending generally parallel to the side edges, and cooperating to hold the panel with which they are associated in contact with a package when the release liners are removed.

The first and second fold lines may comprise lines of weakness (such as perforation lines or any other conventional line of weakness). The first and second patterns of adhesive or cohesive are preferably pressure activated cohesive patterns such as shown in U.S. Pat. No. 5,193,850 which are sealed by passing them through conventional equipment capable of applying about 100–200 pounds per lineal inch. At least one element of each pattern is disposed on both the first and second faces.

In the preferred embodiment the intermediate consists essentially of the first, second, and third panels, and is adapted to be Z-folded, or eccentrically Z-folded, about the first and second fold lines. In such a construction the first pattern of cohesive is provided on the first face in the second and third panels, and the second pattern is provided on the second face in the first and second panels, and the pressure sensitive adhesive patterns are provided on the second face in the third panel, and covers at least 75% of (and preferably at least 90% of) the side strips on the third panel second face.

Each of the detachable side strips is preferably between about 0.8–1.5 inches wide in a dimension parallel to the end edges, or any other smaller range within that broad range (e.g. between about 1–1.25 inches, e.g. about 1⅛ inches). The pressure sensitive adhesive patterns preferably are continuous strips of pressure sensitive adhesive, and the patterns of pressure activated cohesive may be continuous strips, discontinuous strips, spaced cooperating dots or spots of any shape, or any other conventional pattern.

In the preferred embodiment, after feeding into a laser or impact printer (e.g. with a portrait orientation), outgoing address indicia is imaged on the first panel first face (and return address indicia may be variably imaged, or non-variably imaged at an earlier stage). The intermediate also preferably further comprises instructional indicia on how to detach a packing list or bill of lading formed by Z or eccentric Z-folding of the intermediate imaged on the first panel first face adjacent the first end edge. The intermediate also preferably further comprises informational indicia imaged on the second and third panels first and second faces between the first and second lines of weakness, and on the second face of the first panel.

Optionally the intermediate may further comprise a third pattern of pressure activated cohesive disposed on the first face of the second and third panels adjacent the first fold line and second end edge, respectively, and extending substantially parallel to the first fold line; and third and fourth lines of weakness formed in the second and third panels on the opposite sides of the third patterns from the first fold line and second end edge, respectively, for allowing ready separation of the second and third panels from each other. Also optionally the intermediate may still further comprise a fourth pattern of pressure activated cohesive disposed on the second face of the first and second panels adjacent the first end edge and second fold line, respectively, and extending substantially parallel to the second fold line; and fifth and sixth lines of weakness formed in the first and second panels on the opposite sides of the fourth patterns from the first end edge and second fold line, respectively for allowing ready separation of the first and second panels from each other.

The invention also relates to a business form (e.g. packing list or bill of lading) constructed from an intermediate as described above. Such a business form comprises the following elements: First, second, and third plies formed from a single sheet of paper, each ply having top and bottom faces, substantially parallel first and second side edges and substantially parallel, and substantially perpendicular to the side edges, end edges. The second ply sandwiched between the first and third plies with the first ply bottom face facing the second ply top face, and the second ply bottom face facing the third ply top face. Aligned first and second lines of weakness formed in the plies substantially parallel to and near the first and second side edges, respectively, and defining first and second detachable side strips, respectively, in each of the plies. A first pattern of adhesive or cohesive provided in the detachable side strips of at least one of the first panel bottom face and second panel top face for holding the first and second panels together. A second pattern of adhesive or cohesive provided in the detachable side strips of at least one of the second panel bottom face and third panel top face for holding the second and third panels together. Informational indicia imaged on both the top and bottom faces of both the second and third plies between the first and second lines of weakness. Outgoing and return address indicia imaged on the first ply top face. And, patterns of pressure sensitive adhesive covered by release strips disposed only in the detachable side strips of the third panel in the bottom face and extending generally parallel to the first and second lines of weakness.

Each of the detachable side strips preferably extends about 0.8–1.5 inches in a dimension parallel to the end edges (e.g. are about 1–1.25 inches wide). Also preferably instructional indicia is imaged on the first panel first face adjacent the first end edge on how to detach the business form from a package, and other informational indicia is imaged on the bottom face of the first ply.

The invention also relates to a package (such as an envelope, box, carton, tube, etc.) having the business form described above attached thereto substantially solely by the patterns of pressure sensitive adhesive after the release strips have been removed therefrom, so that the outgoing address indicia is clearly visible from the exterior of the package.

It is the primary object of the present invention to provide an advantageous intermediate, business form produced from the intermediate, and package having the business form attached thereto. This and other objects of the invention will become clear from an inspection of the detailed description of the invention and from the appended claims.

DETAILED DESCRIPTION OF THE DRAWINGS

Figure 1:
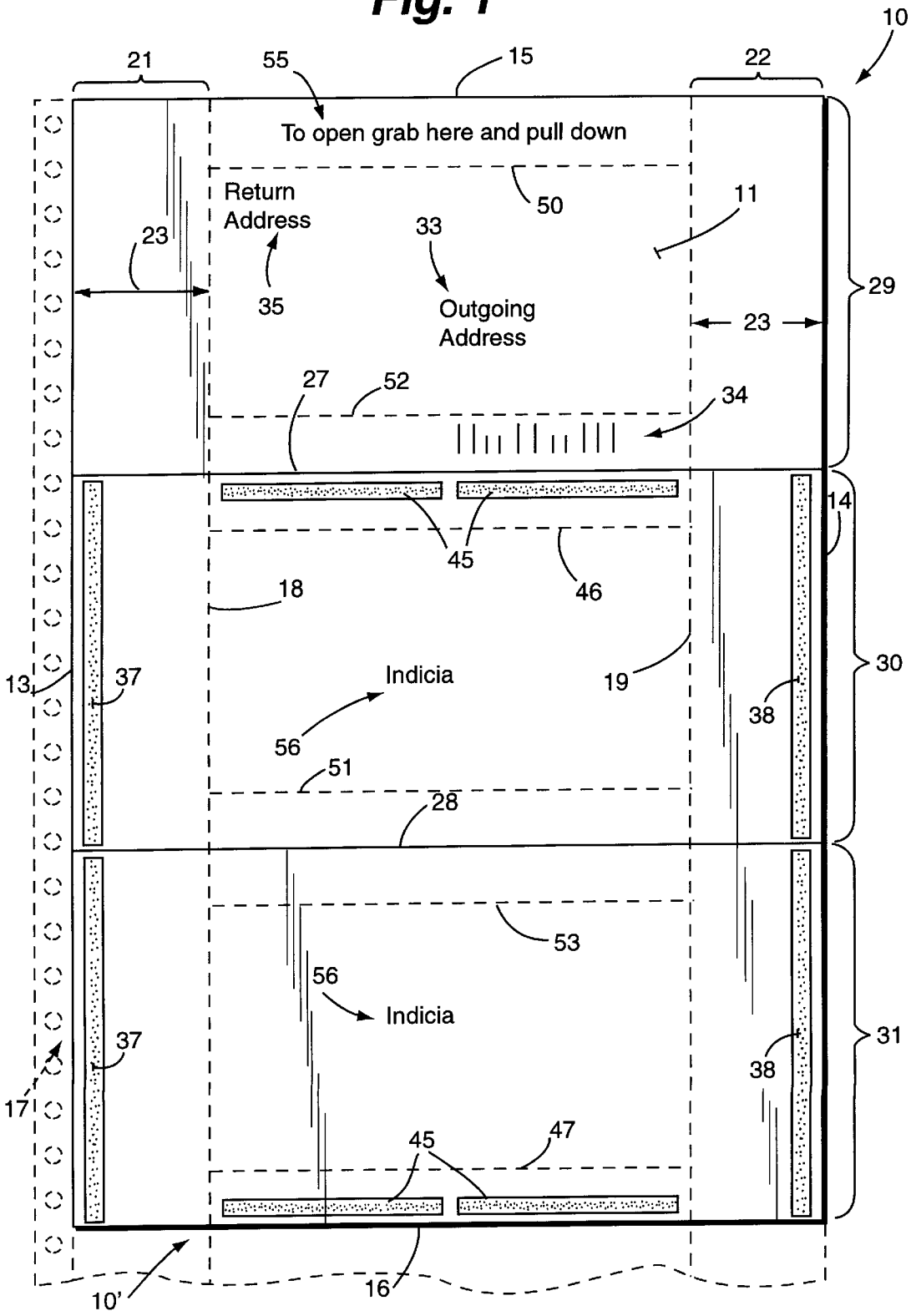
FIG. 1 is a top plan view of an exemplary intermediate for a business form pursuant to the present invention.

An exemplary business form intermediate (such as for a packing list or bill of lading type business form) according to the present invention is shown generally by reference numeral 10 in FIGS. 1, 2, 3, and 8. The intermediate 10 comprises a single substantially quadrate sheet of standard paper (such as bond paper of any suitable size, preferably thirteen inch or fourteen inch legal size, but also possibly A4 size, or letter size). A first face 11 (FIG. 1) and a second face 12 (FIG. 2), first and second side edges 13, 14 substantially parallel to each other, and first and second end edges 15, 16 substantially parallel to each other and substantially transverse to the side edges 13, 14. The intermediate 10 may be in cut sheet form as illustrated in solid line in FIG. 1, and in FIGS. 2 and 3, or may be in continuous form. When in continuous form preferably the end edges 15, 16 thereof are lines of weakness (such as perforation lines) connecting the intermediate 10 to like intermediates, such as the intermediate indicated schematically in dotted line at 10' in FIG. 1. Also if desirable removable tractor drive strips, shown in dotted line at 17 in FIG. 1, may be provided along one or both of the side edges 13, 14.

Figure 4:
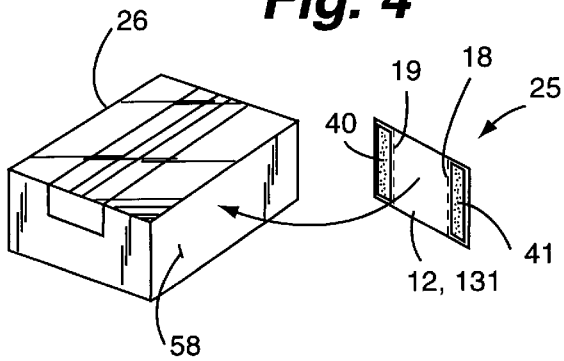
FIG. 4 is a perspective schematic view showing a package with a business form according to the present invention about to be applied thereto.

The intermediate 10 also comprises first and second lines of weakness 18, 19 substantially parallel to each other and substantially parallel to and near the first and second side edges 13, 14, respectively. The lines of weakness 18, 19 define with the side edges 13, 14, respectively, first and second detachable side strips 21, 22. While the width 23 (see FIG. 1) of the side strips 21, 22 may vary (and in fact although the widths 23 of the strips 21, 22 are preferably substantially the same, they can be different), in the preferred embodiment the width 23 is fairly large, preferably between about 0.8–1.5 inches, or any other smaller range within that broad range (e.g. between about 1–1.25 inches, e.g. about 1⅛ inches). The width 23 should be great enough so that an appropriate amount of pressure sensitive adhesive can be associated therewith for properly holding the business form 25 (see FIGS. 4 through 6) produced from the intermediate 10 effectively to a package, such as the package 26 illustrated schematically in FIGS. 4 and 6. [The package 26 may comprise any conventional type of package, such as an envelope, carton, box, or tube.]

The intermediate 10 further comprises at least first and second fold lines 27, 28 (which may be creases, score lines, or lines of weakness such as perforation lines) which are substantially parallel to the end edges 15, 16, and define the intermediate 10 into at least three panels, the first panel 29 between the end edge 15 and first fold line 27, a second panel 30 between the fold lines 27, 28, and a third panel 31 on the opposite side of the fold line 28 from the panel 30. In the preferred embodiment illustrated the intermediate 10 consists essentially of the panels 29–31, the third panel 31 being defined between the second fold line 28 and the second end edge 16. In other embodiments four or even more panels 29–31 may be provided. In the embodiment illustrated in FIGS. 1 through 3 the panels 29–31 are of substantially the same dimensions, although if an eccentric Z-folded business form is to be produced from the intermediate 10 one of the panels 29, 31 (preferably the panel 29) can have a lesser length along its side edges 13, 14. While the intermediate 10 of FIGS. 1 through 3 is specifically designed to be Z-folded, other constructions may be provided including C-folded, double folded, or the like.

Figure 3:
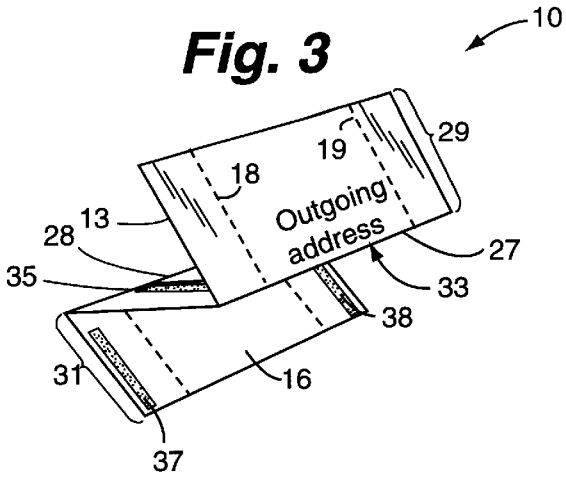
FIG. 3 is a top perspective schematic view showing the intermediate of FIGS. 1 and 2 being Z-folded about the fold lines thereof.
Figure 8:
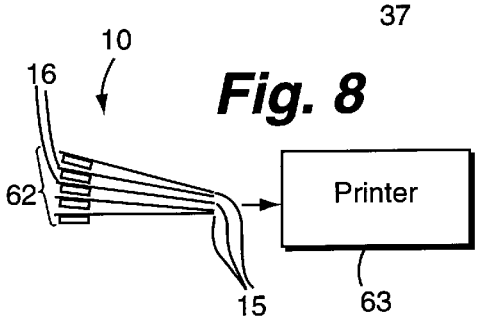
FIG. 8 is a schematic view illustrating feeding of a stack of intermediates according to FIGS. 1 and 2 to a conventional laser or impact printer.

As seen in FIGS. 1 and 3, the first panel 29 first face 11 is substantially devoid of adhesive or cohesive (at least between the lines of weakness 18, 19 thereof), which does not preclude utilization of adhesive to apply a label to the face 11 containing a bar code, outgoing address indicia, or the like. The face 11 is specifically adapted to receive variable outgoing address indicia 33 thereon (see FIGS. 1, 3, 6, and 7) which may be in human readable form or both human readable and machine readable (bar code 34) form. Return address indicia 35, which is either variable or non-variable, may also be imaged on the panel 29 first face 11 as seen in FIG. 1.

The intermediate 10 further comprises first and second patterns of adhesive or cohesive disposed in the detachable side strips 21, 22 for holding the intermediate 10 in a folded configuration when folded about the fold lines 27, 28. In the drawings these patterns are shown as pressure activated cohesive strips, such as shown in U.S. Pat. No. 5,193,850, although it is to be understood that heat activated or rewettable adhesive, or other types of cohesive, may be utilized instead. Where adhesive is utilized instead of cohesive, there need not be cooperating portions of the pattern but rather an adhesive pattern may simply adhere to the part of the paper forming the intermediate 10.

Figure 2:
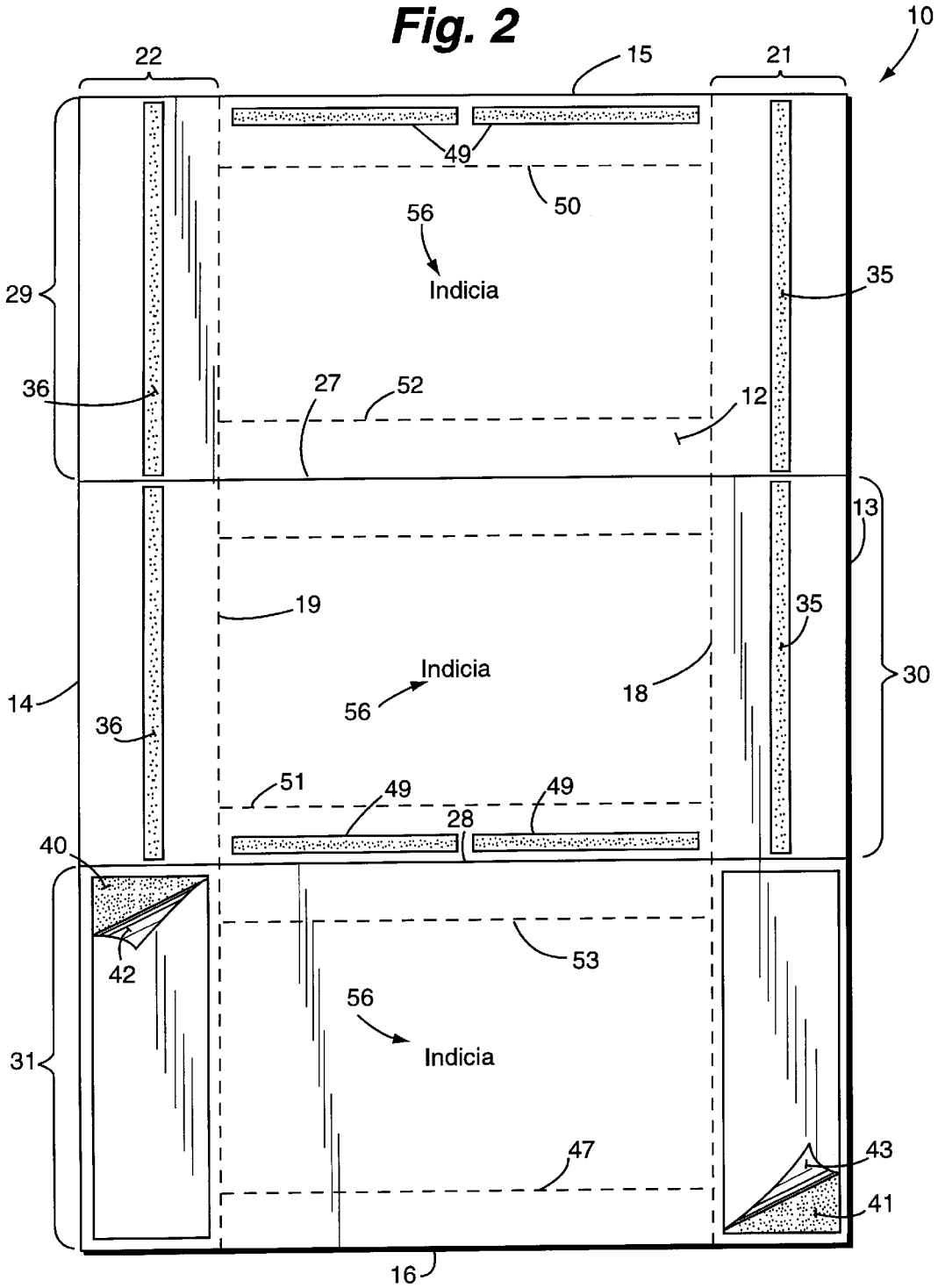
FIG. 2 is a bottom plan view of the intermediate of FIG. 1.

In the preferred embodiment illustrated in FIGS. 1 and 2, the first pattern of pressure activated cohesive comprises the discontinuous strips 35, 36 (see FIG. 2) disposed in the detachable side strips 21, 22 in both the panels 29, 30 on the second face 12 thereof. That way when the intermediate 10 is Z-folded (or eccentrically Z-folded) about the fold line 27 the strips 35 will come into contact with each other, and the strips 36 will come into contact with each other. The second pattern of pressure activated cohesive comprises the discontinuous strips 37, 38 provided in the second and third panels 30, 31 on the first face 11 thereof. When the intermediate 10 is Z-folded about the fold line 28 (see FIG. 3) the strips 37 come into contact with each other, and the strips 38 come into contact with each other. As seen in both FIGS. 3 and 5, preferably the strips 35, 37 and 36 and 38, respectively, are spaced from each other in a dimension parallel to the end edges 15, 16, which maximizes the ease of handling the intermediates 10 and minimizes curl or other possible adverse results.

The intermediate 10 further comprises (see FIG. 2) two patterns of pressure sensitive adhesive—such as the strips 40, 41—each covered by a conventional adhesive release liner 42, 43 (see FIG. 2). The patterns 40, 41 are disposed on the same face of one of the second and third panels, and substantially only in the detachable side strips 21, 22, to hold the panel with which they are associated in contact with the package 26 when the release liners 42, 43 are removed. In the Z-fold configuration illustrated in FIGS. 1 and 2, the strips 40, 41 are provided on the second face 12 of the third panel 31 and extend substantially parallel to the side edges 13, 14 and take up the vast majority of the detachable side strips 21, 22 in the third panel 31 (e.g. at least 75% and preferably more than 90%, of the area of the side strips 21, 22). However preferably no adhesive is provided in that portion of the panel 31 between the lines of weakness 18, 19 (see FIG. 2). The pressure sensitive adhesive 40, 41 may be of any conventional type, permanent, removable, repositional, and of conventional suitable chemical formulation, but preferably comprises permanent adhesive.

In FIGS. 1 and 2 (although not in the other figures) optional other cohesive strips and lines of weakness are illustrated, for use if it is desired to more securely hold the panels 29–31 together when folded about the fold lines 27, 28, or where a high degree of confidentiality is desired. For example as seen in FIG. 1 a third pattern of pressure activated cohesive is disposed on the first face 11 of the second and third panels 30, 31 in the form of the discontinuous strips 45, which come into contact with each other when the intermediate 10 is Z-folded about the fold line 28. In this arrangement third and fourth lines of weakness 46, 47 are provided in the panels 30, 31, respectively, substantially parallel to the end edges 15, 16 and on the opposite sides of the first fold line 27 second end edge 16 from the patterns 45, respectively, to facilitate complete opening of a business form 25 formed from the intermediate 10 if the cohesive strips 45 are used.

As illustrated in FIG. 2, the intermediate 10 may also include an optional fourth pattern of pressure activated cohesive, such as in the form of the discontinuous strips 49, provided on the second face 12 of the first and second panels 29, 30 adjacent the first end edge 15 and second fold line 28, respectively. When the strips 49 are utilized, there also preferably is provided fifth and sixth lines of weakness 50, 51, respectively. The lines of weakness 50, 51 are parallel to the end edges 15, 16, and are on the opposite sides of the first end edge 15 and second fold line 28, respectively, from the cohesive strips 49. If desired other lines of weakness 52, 53 may also be provided in the first and third panels 29, 31.

The intermediate 10 also preferably has a wide variety of other indicia aside from the address indicia 33–35, associated therewith. For example imaged on the first face 11 of the first panel 29 adjacent the first end edge 15 preferably is instructional indicia 55 instructing the addressee on how to remove the form 25 from the package 26 to which it is adhered. Also informational indicia, shown both in FIGS. 1 and 2 generally by reference numeral 56, of any type (including receipt indicia, lading information, contents of the package indicia, return stub indicia, etc.) is imaged on both the first and second faces 11, 12 of both the panels 30, 31, and preferably on the second face 12 of the first panel 29 too. Because in the ultimately removed (from the package 26) configuration of the business form 25 the addressee can readily remove both the faces 11, 12 of what are the panels 29–31 of the intermediate 10, indicia 56 can be provided in all those places, making the intermediate 10, and form 25 produced therefrom, very versatile.

Figure 5:
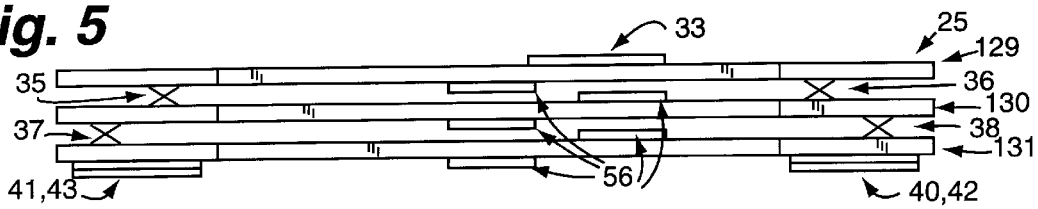
FIG. 5 is a schematic end view of an exemplary business form formed by Z-folding the intermediate of FIGS. 2 and 3, with any end edges of the paper forming the business form removed for clarity of illustration.
Figure 6:
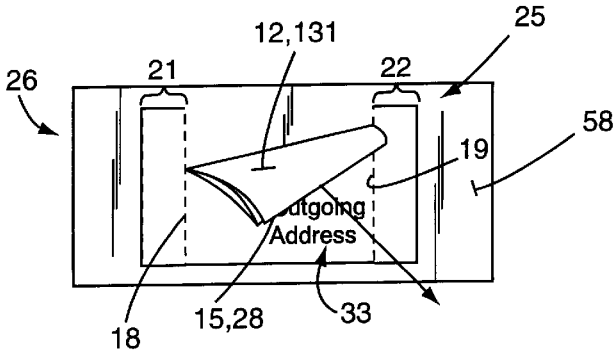
FIG. 6 is an end view of the package of FIG. 4 after the business form according to the invention has been applied, and schematically showing how the business form is detached from the package.

After the intermediate 10 is Z-folded about the fold lines 27, 28 (as seen in FIG. 3), which is after the variable indicia 33 (and any other variable indicia) is applied thereto, all of the cohesive patterns 35–38 (and the patterns 45, 49 if provided) are sealed by passing the folded intermediate through conventional sealing equipment (such as a Moore SpeediSealer®), to produce the business form 25. The business form 25 has three plies, as seen most clearly in FIGS. 5 and 7. The first ply 129 corresponds to the first panel 29, the second ply 130 corresponds to the second panel 30 (when the intermediate 10 is Z-folded), and the third ply 131 corresponds to the third panel 31. The indicia 33, 56 is illustrated schematically in FIG. 5 shown on the various faces of the plies 129–131. That is the top face of the first ply 129 has the indicia 33 (as well as 34, 35, and 55 when present), while preferably the bottom face of the first ply 129, and the top and bottom faces of the second and third plies 130, 131, include the informational indicia 56.

To use the business form 25, one merely strips away the release liners 42, 43 (shown partially removed in FIG. 2 and completely removed in FIG. 4) and the adhesive strips 40, 41 are pressed into contact with an appropriate face (e.g. the face 58 schematically illustrated in FIGS. 4 and 6) of the package 26. This puts the bottom face (12) of the third ply (131) adjacent the face 58 of the package 26, as seen in both FIGS. 4 and 6. The package 26 is then shipped as is conventional.

Figure 7:
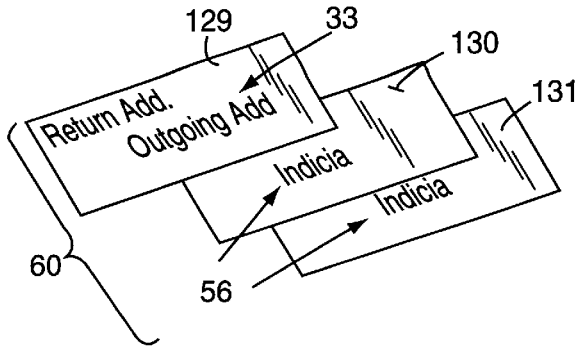
FIG. 7 is an exploded perspective view of the business form of FIGS. 4 through 6 after it has been detached from the package of FIGS. 4 and 6 and the individual plies separated from each other.

When the package 26 is received by the outgoing addressee (33), following the instructional indicia 55 the addressee grabs the top of the form 25 (which then comprises the first end edge 15 and the second fold line 28) and pulls down, tearing along the lines of weakness 18, 19 to provide the detached form portion illustrated generally at 60 in FIG. 7. The detachable side strips 21, 22 remain adhered to the package 26. By tearing along the fold lines/lines of weakness 27, 28, each of the remaining ply portions 129, 130, 131 of the remainder 60 of the form 25 may be detached from each other, as illustrated in FIG. 7, and any use put to them which is desired, or required by any of the indicia 56 imaged thereon.

In the variable imaging (which may include portions of the indicia 56 as well as the outgoing address 33) of the intermediates 10, if the sheets 10 are in zigzag format then the stack 62 formed thereby (see the schematic illustration in FIG. 8 of a stack 62, but not a stack with this configuration) would not lean. However where the intermediates 10 are merely stacked as cut sheets one atop each other, as illustrated for the stack 62 in FIG. 8, even though the stack 62 leans since the ends 15 would typically be the leading edges fed to the conventional printer 63, leaning does not particularly adversely affect feeding of the printer 63. The intermediates 10 may easily be imaged in portrait configuration, as illustrated by the orientation of the indicia 33, 56 with respect to the intermediate 10 in FIGS. 1 and 2.

It will thus be seen that according to the present invention a highly advantageous intermediate, and business form produced therefrom, particularly one that can be used as a packing list, bill of lading, or the like, have been provided. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent products and devices.

What is claimed is:

1. An intermediate for a business form, comprising:

a single substantially quadrate sheet of paper having first and second faces, first and second side edges substantially parallel to each other, and first and second end edges substantially parallel to each other and substantially perpendicular to said side edges;

first and second lines of weakness substantially parallel to and near said first and second side edges and defining first and second detachable side strips;

at least first and second fold lines substantially parallel to said end edges and defining said sheet into at least three panels, a first panel between said first end edge and said first fold line, a second panel between said first and second fold lines, and a third panel;

first and second patterns of pressure activated cohesive with at least one element of each pattern disposed on both said first and second faces, and disposed in said detachable side strips for holding said intermediate in a folded configuration when folded about said fold lines;

said first panel first face being substantially devoid of adhesive or cohesive;

two patterns of pressure sensitive adhesive each covered by a release liner, said adhesive patterns disposed on the same face of one of said second and third panels, and substantially only in said detachable side strips thereof, extending generally parallel to said side edges, and cooperating to hold the panel with which they are associated in contact with a package when said release liners are removed; and wherein said intermediate consists essentially of said first, second and third panels, and is adapted to be Z-folded, or eccentrically Z-folded, about said first and second fold lines; and wherein said first pattern of cohesive is provided on said first face in said second and third panels, and said second pattern is provided on said second face in said first and second panels; and wherein said pressure sensitive adhesive patterns are provided on said second face in said third panel.

2. An intermediate as recited in claim 1 wherein each of said detachable side strips extends between about 0.8–1.5 inches in a dimension parallel to said end edges.

3. An intermediate as recited in claim 2 wherein said pressure sensitive adhesive patterns are continuous strips of pressure sensitive adhesive, and said patterns of pressure activated cohesive are discontinuous strips.

4. An intermediate as recited in claim 1 wherein said pressure sensitive adhesive covers at least 75% of said side strips on said third panel second face.

5. An intermediate as recited in claim 4 further comprising outgoing and return address indicia imaged on said first panel first face.

6. An intermediate as recited in claim 5 further comprising instructional indicia, indicating how to detach a business form formed by Z or eccentric Z-folding of said intermediate, imaged on said first panel first face adjacent said first end edge.

7. An intermediate as recited in claim 6 further comprising informational indicia imaged on said second and third panel first and second faces between said first and second lines of weakness; and wherein said first and second fold lines are lines of weakness.

8. An intermediate as recited in claim 7 further comprising: a third pattern of pressure activated cohesive disposed on said first face of said second and third panels adjacent said first fold line and second end edge, respectively, and extending substantially parallel to said first fold line; and third and fourth lines of weakness formed in said second and third panels on the opposite sides of said third patterns from said first fold line and second end edge, respectively, for allowing ready separation of said second and third panels from each other.

9. An intermediate as recited in claim 8 further comprising: a fourth pattern of pressure activated cohesive disposed on said second face of said first and second panels adjacent said first end edge and second fold line, respectively, and extending substantially parallel to said second fold line; and fifth and sixth lines of weakness formed in said first and second panels on the opposite sides of said fourth patterns from said first end edge and second fold line, respectively, for allowing ready separation of said first and second panels from each other.

10. An intermediate for a business form, comprising:

a single substantially quadrate sheet of paper having first and second faces, first and second side edges substantially parallel to each other, and first and second end edges substantially parallel to each other and substantially perpendicular to said side edges;

first and second lines of weakness substantially parallel to and near said first and second side edges and defining first and second detachable side strips;

at least first and second fold lines substantially parallel to said end edges and defining said sheet into at least three panels, a first panel between said first end edge and said first fold line, a second panel between said first and second fold lines, and a third panel;

first and second patterns of adhesive or cohesive disposed in said detachable side strips for holding said intermediate in a folded configuration when folded about said fold lines;

said first panel first face being substantially devoid of adhesive or cohesive;

two patterns of pressure sensitive adhesive each covered by a release liner, said adhesive patterns disposed on the same face of one of said second and third panels, and substantially only in said detachable side strips thereof, extending generally parallel to said side edges, and cooperating to hold the panel with which they are associated in contact with a package when said release liners are removed;

wherein said intermediate consists essentially of said first, second and third panels, and is adapted to be Z-folded, or eccentrically Z-folded, about said first and second fold lines; and wherein said pressure sensitive adhesive patterns are provided on said second face in said third panel; and further comprising outgoing and return address indicia imaged on said first panel first face.

11. An intermediate as recited in claim 10 wherein each of said detachable side strips extends between about 0.8–1.5 inches in a dimension parallel to said end edges.

12. An intermediate as recited in claim 10 further comprising instructional indicia, indicating how to detach a business form formed by Z or eccentric Z-folding of said intermediate, imaged on said first panel first face adjacent said first end edge.

13. An intermediate as recited in claim 12 further comprising informational indicia imaged on said second and third panel first and second faces, and said first panel second face, between said first and second lines of weakness.

14. An intermediate as recited in claim 10 further comprising informational indicia imaged on said second and third panel first and second faces, and said first panel second face, between said first and second lines of weakness.

15. An intermediate as recited in claim 10 wherein each of said detachable side strips extends between about 1–1.25 inches in a dimension parallel to said end edges; and wherein said pressure sensitive adhesive covers at least 75% of said side strips on said third panel second face.

16. A business form comprising:

first, second, and third plies formed from a single sheet of paper, each ply having top and bottom faces, substantially parallel first and second side edges and substantially parallel, and substantially perpendicular to said side edges, end edges;

said second ply sandwiched between said first and third plies with said first ply bottom face facing said second ply top face, and said second ply bottom face facing said third ply top face;

aligned first and second lines of weakness formed in said plies substantially parallel to and near said first and second side edges, respectively, and defining first and second detachable side strips, respectively, in each of said plies;

a first pattern of adhesive or cohesive provided in said detachable side strips of at least one of said first panel bottom face and second panel top face for holding said first and second panels together;

a second pattern of adhesive or cohesive provided in said detachable side strips of at least one of said second panel bottom face and third panel top face for holding said second and third panels together;

informational indicia imaged on both said top and bottom faces of both said second and third plies between said first and second lines of weakness;

outgoing and return address indicia imaged on said first ply top face; and patterns of pressure sensitive adhesive covered by release strips disposed only in said detachable side strips of said third panel in said bottom face and extending generally parallel to said first and second lines of weakness.

17. A business form as recited in claim 16 wherein each of said detachable side strips extends between about 0.8–1.5 inches in a dimension parallel to said end edges.

18. A business form as recited in claim 17 further comprising instructional indicia imaged on said first panel first face adjacent said first end edge indicating how to detach said business form from a package; and wherein said pressure sensitive adhesive covers at least 75% of said side strips on said third ply bottom face.

19. A business form as recited in claim 16 further comprising instructional indicia imaged on said first panel first face adjacent said first end edge indicating how to detach said business form from a package, and informational indicia is imaged on the bottom face of the first ply.

20. A package having the business form of claim 18 attached thereto substantially solely by said patterns of pressure sensitive adhesive after said release strips have been removed, so that said outgoing address indicia is clearly visible on said package.

* * * * *